US007399565B2

(12) United States Patent
Wu et al.

(10) Patent No.: US 7,399,565 B2
(45) Date of Patent: Jul. 15, 2008

(54) IMAGING MEMBER HAVING UNDERCOAT LAYER COMPRISING PORPHINE ADDITIVE

(75) Inventors: Jin Wu, Webster, NY (US); Daniel V. Levy, Rochester, NY (US); Liang-bih Lin, Rochester, NY (US); Francisco Lopez, Rochester, NY (US)

(73) Assignee: Xerox Corporation, Norwalk, CT (US)

( * ) Notice: Subject to any disclaimer, the term of this patent is extended or adjusted under 35 U.S.C. 154(b) by 380 days.

(21) Appl. No.: 11/257,356

(22) Filed: Oct. 24, 2005

(65) Prior Publication Data

US 2007/0092816 A1 Apr. 26, 2007

(51) Int. Cl.
*G03G 5/14* (2006.01)

(52) U.S. Cl. ..... 430/65; 399/159

(58) Field of Classification Search ..... 430/78, 430/65, 57.2, 59.1, 59.4; 399/159
See application file for complete search history.

(56) References Cited

U.S. PATENT DOCUMENTS

| | | | | |
|---|---|---|---|---|
| 4,518,669 | A | 5/1985 | Yashiki | |
| 4,579,801 | A | 4/1986 | Yashiki | |
| 4,775,605 | A | 10/1988 | Seki et al. | |
| 5,017,449 | A | 5/1991 | Yoshihara | |
| 5,344,734 | A | 9/1994 | Monbalin et al. | |
| 5,489,496 | A | 2/1996 | Katayama et al. | |
| 5,641,599 | A | 6/1997 | Markovics et al. | |
| 5,656,407 | A | 8/1997 | Kawahara | |
| 5,721,080 | A | 2/1998 | Terrell et al. | |
| 5,821,021 | A * | 10/1998 | Kawahara | 430/78 |
| 6,180,309 | B1 | 1/2001 | Maty et al. | |
| 6,200,716 | B1 | 3/2001 | Fuller et al. | |
| 6,207,334 | B1 | 3/2001 | Dinh et al. | |
| 6,683,175 | B2 * | 1/2004 | Tanaka | 430/78 |
| 7,183,026 | B2 * | 2/2007 | Zhu et al. | 430/57.2 |
| 7,312,007 | B2 | 12/2007 | Lin et al. | |
| 2007/0048639 | A1 | 3/2007 | Wu et al. | |

FOREIGN PATENT DOCUMENTS

| | | | |
|---|---|---|---|
| EP | 1308481 | A2 * | 5/2003 |

* cited by examiner

*Primary Examiner*—Christopher RoDee
(74) *Attorney, Agent, or Firm*—Pillsbury Winthrop Shaw Pittman LLP

(57) ABSTRACT

The presently disclosed embodiments relate in general to electrophotographic imaging members, such as layered photoreceptor structures, and processes for making and using the same. More particularly, the embodiments pertain to a photoreceptor underlayer comprising a metal oxide and a porphine additive to eliminate charge deficient spots in specific conditions and improve image quality.

9 Claims, No Drawings

IMAGING MEMBER HAVING UNDERCOAT LAYER COMPRISING PORPHINE ADDITIVE

BACKGROUND

Herein disclosed are imaging members, such as layered photoreceptor structures, and processes for making and using the same. The imaging members can be used in electrophotographic, electrostatographic, xerographic and like devices, including printers, copiers, scanners, facsimiles, and including digital, image-on-image, and like devices. More particularly, the embodiments pertain to a photoreceptor that incorporates specific molecules to facilitate electron transport across the layers of the photoreceptor device.

Electrophotographic imaging members, e.g., photoreceptors, typically include a photoconductive layer formed on an electrically conductive substrate. The photoconductive layer is an insulator in the substantial absence of light so that electric charges are retained on its surface. Upon exposure to light, charge is generated by the photoactive pigment, and under applied field charge moves through the photoreceptor and the charge is dissipated.

In electrophotography, also known as xerography, electrophotographic imaging or electrostatographic imaging, the surface of an electrophotographic plate, drum, belt or the like (imaging member or photoreceptor) containing a photoconductive insulating layer on a conductive layer is first uniformly electrostatically charged. The imaging member is then exposed to a pattern of activating electromagnetic radiation, such as light. Charge generated by the photoactive pigment move under the force of the applied field. The movement of the charge through the photoreceptor selectively dissipates the charge on the illuminated areas of the photoconductive insulating layer while leaving behind an electrostatic latent image. This electrostatic latent image may then be developed to form a visible image by depositing oppositely charged particles on the surface of the photoconductive insulating layer. The resulting visible image may then be transferred from the imaging member directly or indirectly (such as by a transfer or other member) to a print substrate, such as transparency or paper. The imaging process may be repeated many times with reusable imaging members.

An electrophotographic imaging member may be provided in a number of forms. For example, the imaging member may be a homogeneous layer of a single material such as vitreous selenium or it may be a composite layer containing a photoconductor and another material. In addition, the imaging member may be layered. These layers can be in any order, and sometimes can be combined in a single or mixed layer.

Typical multilayered photoreceptors have at least two layers, and may include a substrate, a conductive layer, an optional charge blocking layer, an optional adhesive layer, a photogenerating layer (sometimes referred to as a "charge generation layer," "charge generating layer," or "charge generator layer"), a charge transport layer, an optional overcoating layer and, in some belt embodiments, an anticurl backing layer. In the multilayer configuration, the active layers of the photoreceptor are the charge generation layer (CGL) and the charge transport layer (CTL). Enhancement of charge transport across these layers provides better photoreceptor performance.

The demand for improved print quality in xerographic reproduction is increasing, especially with the advent of color. Common print quality issues are strongly dependent on the quality of the undercoat layer. Conventional materials used for the undercoat or blocking layer have been problematic. In certain situations, a thicker undercoat is desirable, but the thickness of the material used for the undercoat layer is limited by the inefficient transport of the photo-injected electrons from the generator layer to the substrate. If the undercoat layer is too thin, then incomplete coverage of the substrate results due to wetting problems on localized unclean substrate surface areas. The incomplete coverage produces pin holes which can, in turn, produce print defects such as charge deficient spots ("CDS") and bias charge roll ("BCR") leakage breakdown. Other problems include "ghosting," which is thought to result from the accumulation of charge somewhere in the photoreceptor. Consequently, when a sequential image is printed, the accumulated charge results in image density changes in the current printed image that reveals the previously printed image. Thus, there is a need, which is addressed herein, for a way to minimize or eliminate charge accumulation in photoreceptors, without sacrificing the desired thickness of the undercoat layer.

The terms "charge blocking layer" and "blocking layer" are generally used interchangeably with the phrase "undercoat layer."

Conventional photoreceptors and their materials are disclosed in Katayama et al., U.S. Pat. No. 5,489,496; Yashiki, U.S. Pat. No. 4,579,801; Yashiki, U.S. Pat. No. 4,518,669; Seki et al., U.S. Pat. No. 4,775,605; Kawahara, U.S. Pat. No. 5,656,407; Markovics et al., U.S. Pat. No. 5,641,599; Monbaliu et al., U.S. Pat. No. 5,344,734; Terrell et al., U.S. Pat. No. 5,721,080; and Yoshihara, U.S. Pat. No. 5,017,449, which are herein incorporated by reference in their entirety.

More recent photoreceptors are disclosed in Fuller et al., U.S. Pat. No. 6,200,716; Maty et al., U.S. Pat. No. 6,180,309; and Dinh et al., U.S. Pat. No. 6,207,334, which are herein incorporate by reference in their entirety.

SUMMARY

According to embodiments illustrated herein, there is provided a way in which print quality is improved, for example, CDS is minimized or substantially eliminated in images printed in systems.

In one embodiment, there is provided an electrophotographic imaging member, comprising a substrate, an undercoat layer formed on the substrate, wherein the undercoat layer comprises a metal oxide and a porphine additive, and an imaging layer on the undercoat layer.

In another embodiment, there is provided an electrophotographic imaging member, comprising a substrate, an undercoat layer formed on the substrate, the undercoat layer having a thickness of from about 0.1 μm to about 30 μm, and wherein the undercoat layer comprises a metal oxide and a porphine additive, the metal oxide further comprising $TiO_2$ and the porphine additive further comprising meso-tetraphenylporphine-4,4',4",4'"-tetracarboxylic acid, and a charge transport layer comprising charge transport materials dispersed therein.

There is also provided an image forming apparatus for forming images on a recording medium comprising an electrophotographic imaging member having a charge retentive-surface to receive an electrostatic latent image thereon, wherein the electrophotographic imaging member comprises a substrate, an undercoat layer formed on the substrate, wherein the undercoat layer comprises a metal oxide and a porphine additive, and at least one imaging layer formed on the undercoat layer, a development component to apply a developer material to the charge-retentive surface to develop the electrostatic latent image to form a developed image on the charge-retentive surface, a transfer component for transferring the developed image from the charge-retentive surface to another member or a copy substrate, and a fusing member to fuse the developed image to the copy substrate.

DETAILED DESCRIPTION

It is understood that other embodiments may be utilized and structural and operational changes may be made without departure from the scope of the embodiments disclosed herein.

The embodiments relate to a photoreceptor having a undercoat layer which incorporates an additive to the formulation that helps reduce, or substantially eliminates, specific printing defects in the print images that are present in specific conditions.

According to embodiments herein, an electrophotographic imaging member is provided, which generally comprises at least a substrate layer, an undercoat layer, and an imaging layer. The undercoating layer is generally located between the substrate and the imaging layer, although additional layers may be present and located between these layers. The imaging member may also include a charge generation layer and a charge transport layer. The imaging member can be employed in the imaging process of electrophotography, where the surface of an electrophotographic plate, drum, belt or the like (imaging member or photoreceptor) containing a photoconductive insulating layer on a conductive layer is first uniformly electro statically charged. The imaging member is then exposed to a pattern of activating electromagnetic radiation, such as light. The radiation selectively dissipates the charge on the illuminated areas of the photoconductive insulating layer while leaving behind an electrostatic latent image. This electrostatic latent image may then be developed to form a visible image by depositing oppositely charged particles on the surface of the photoconductive insulating layer. The resulting visible image may then be transferred from the imaging member directly or indirectly (such as by a transfer or other member) to a print substrate, such as transparency or paper. The imaging process may be repeated many times with reusable imaging members.

Thick undercoat layers are desirable for photoreceptors due to their life extension and carbon fiber resistance. Furthermore, thicker undercoat layers make it possible to use less costly substrates in the photoreceptors. Such thick undercoat layers have been developed, such as one developed by Xerox Corporation and disclosed in U.S. patent application Ser. No. 7,312,007, filed Sep. 16, 2004, entitled "Photoconductive Imaging Members," which is hereby incorporated by reference. However, certain conditions may still cause deficiencies in print quality. For example, "A zone" refers to hot and humid conditions while "C zone" and "J zone" refer to cold and dry conditions, each of which may cause conductivity changes that present problems in xerographic reproduction. High relative humidity hinders image density in the xerographic process, may cause background deposits, leads to developer instability, and may result in an overall degeneration of print quality.

Common print quality issues are strongly dependent on the quality of the undercoat layer. Conventional materials used for the undercoat or blocking layer have been problematic because print quality issues are strongly dependent on the quality of the undercoat layer. For example, charge deficient spots ("CDS") and bias charge roll ("BCR") leakage breakdown are problems the commonly occur. Another problem is "ghosting," which is thought to result from the accumulation of charge somewhere in the photoreceptor. Consequently, when a sequential image is printed, the accumulated charge results in image density changes in the current printed image that reveals the previously printed image.

There have been formulations developed for undercoat layers that, while suitable for their intended purpose, do not address the ghosting effect problem. To alleviate the problems associated with charge block layer thickness and high transfer currents, the addition of a charge transfer molecule to a formulation containing a metal oxide, such as $TiO_2$, is performed to help reduce or substantially eliminate ghosting failure in xerographic reproductions. One such charge transfer molecule is disclosed in commonly assigned U.S. Patent Application Publication 2007/0048639, filed Aug. 26, 2005, entitled "Photoreceptor Additive," which is hereby incorporated by reference in its entirety.

In embodiments, additives, specifically porphine or porphine derivatives, are incorporated into the thick undercoat layer containing the metal oxide. Porphine is also called porphyrin, comprising a fundamental skeleton of four pyrrole nuclei united through the α-positions by four methine groups to form a macrocyclic structure. The combination has demonstrated to substantially reduce CDS levels in xerographic reproduction, even in specific conditions such as A zone conditions.

Typical porphine additives that can be used with embodiments disclosed herein include, but are not limited to, (1) 21H,23H-Porphine, (2) meso-Tetraphenylporphine-4,4',4",4'"-tetracarboxylic acid, (3) 5,10,15,20-Tetra(4-pyridyl)-21H,23H-porphine, (4) 5,10,15,20-Tetraphenyl-21H,23H-porphine, (5) 5,10,15,20-Tetrakis(o-dichlorophenyl)-21H,23H-porphine, (6) 5,10,15,20-Tetrakis(4-trimethylammoniophenyl)porphine tetrachloride, (7) meso-Tetraphenylporphine-4,4',4",4'"-tetracarboxylic acid copper (II), (8) 5,10,15,20-Tetrakis(4-sulfonatophenyl)-21H,23H-porphine copper(II), (9) 5,10,15,20-Tetrakis(pentafluorophenyl)-21H,23H-porphine palladium(II), (10) 2,3,7,8,12,13,17,18-Octaethyl-21H,23H-porphine vanadium (IV) oxide, (11) Phytochlorin, (12) 5,10,15,20-Tetrakis(3-hydroxyphenyl)-21H,23H-porphine, (13) 3,8,13,1 8-Tetramethyl-21H,23H-porphine-2,7,12,17-tetrapropionic acid dihydrochloride, (14) 8,13-Divinyl-3,7,12,17-tetramethyl-21H,23H-porphine-2,18-dipropionic acid cobalt(III) chloride, (15) 8,13,-Bis(ethyl)-3,7,12,17-tetramethyl-21H, 23H-porphine-2,18-dipropionic acid chromium(III) chloride, (16) 3,7,12,17-Tetramethyl-21H,23H-porphine-2,18-dipropionic acid dihydrochloride, (17) meso-Tetraphenylporphine-4,4',4",4'"-tetracarboxylic acid, iron (III) chloride, (18) 8,13-Bis(1-hydroxyethyl)-3,7,12,17-tetramethyl-21H,23H-porphine-2,18-dipropionic acid, (19) 5,10,15,20-Tetrakis(4-sulfonatophenyl)-21H,23H-porphine, manganese (III) chloride, (20) Pyropheophorbide-α-methyl ester, (21) 5,10,15,20-Tetraphenyl-21H,23H-porphine nickel(II), (22) N-Methyl Mesoporphyrin IX, (23) 8,13-Bis(vinyl)-3,7,12,17-tetramethyl-21H,23H-porphine-2,18-dipropionic acid, (24) 29H,31H-tetrabenzo porphine, (25) Uroporphyrin I dihydrochloride, (26) 8,13-Bis(vinyl)-3,7,12,17-tetramethyl-21H,23H-porphine-2,18-dipropionic acid zinc(II), (27) 5,10,15,20-Tetrakis (1-methyl-4-pyridinio) porphine tetra (p-toluenesulfonate), (28) 8,13-Bis(ethyl)-3,7,12,17-tetramethyl-21H,23H-porphine-2,18-dipropionic acid tin(IV) dichloride, and the like and the mixtures thereof. The chemical structures are shown below:

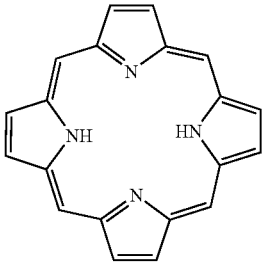
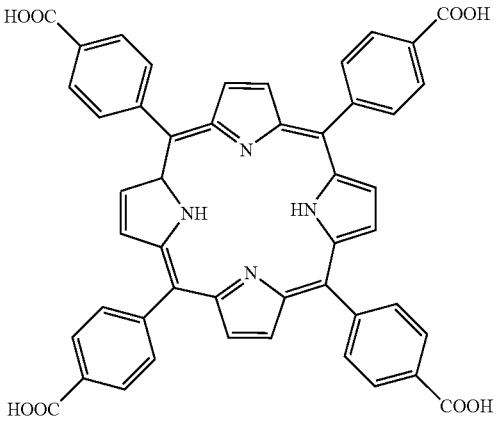
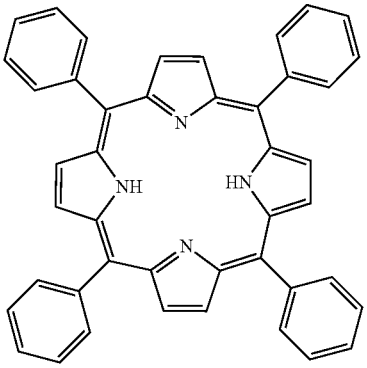
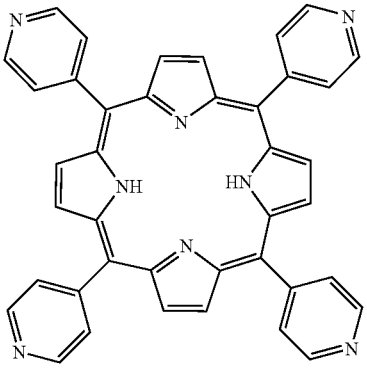
-continued
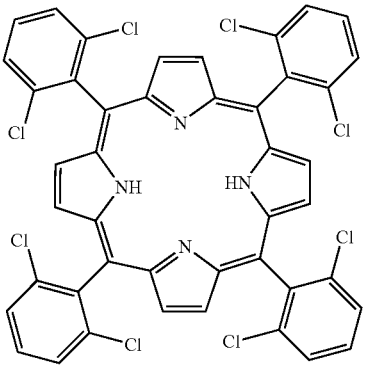
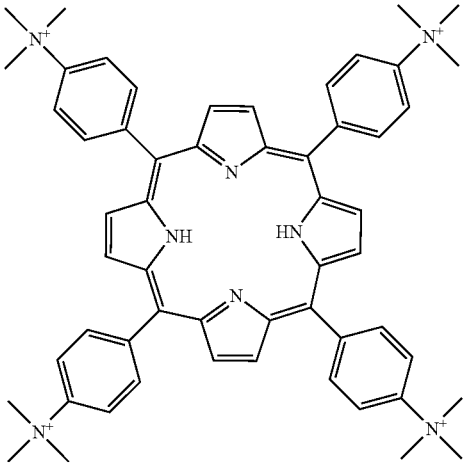
4Cl-
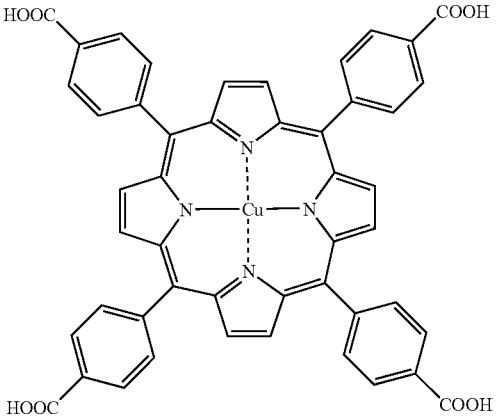

-continued
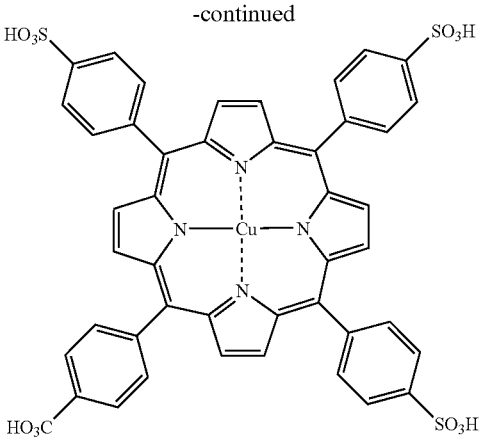
-continued
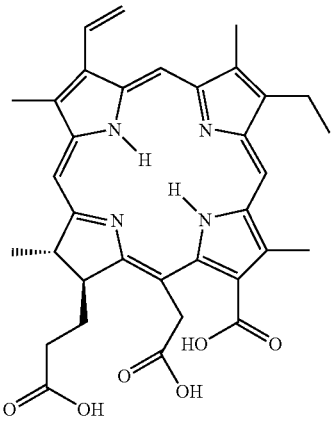
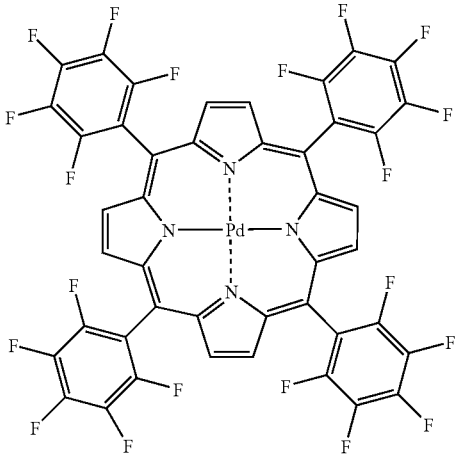
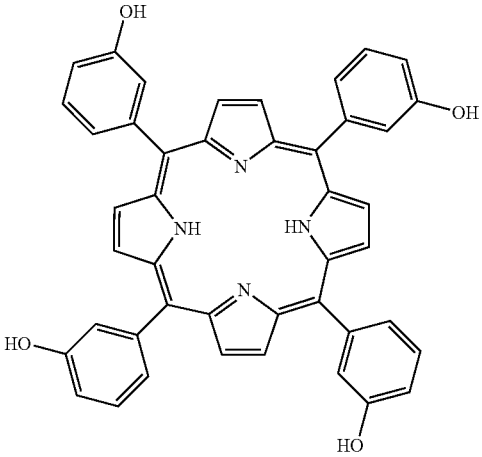
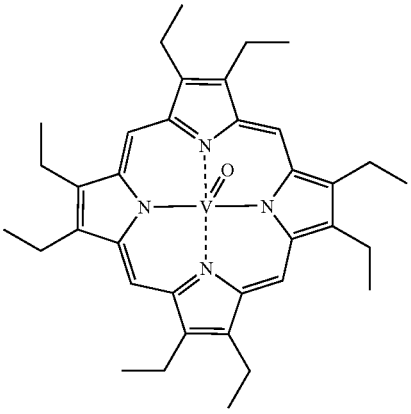
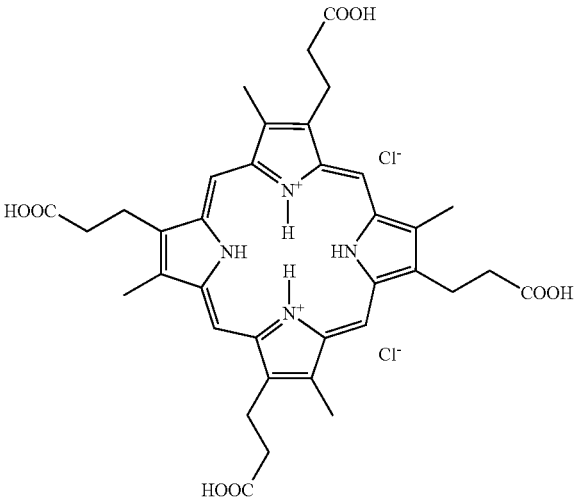

-continued
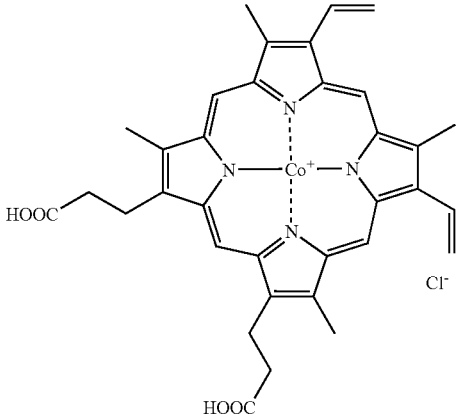
-continued
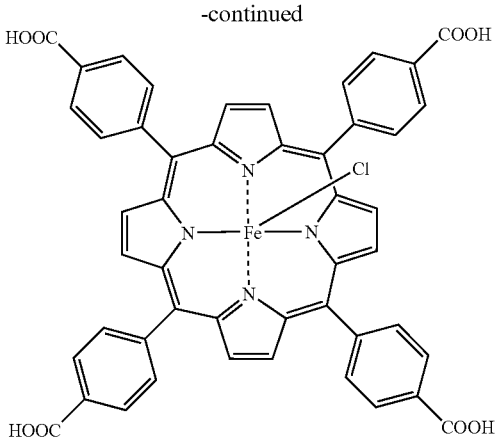
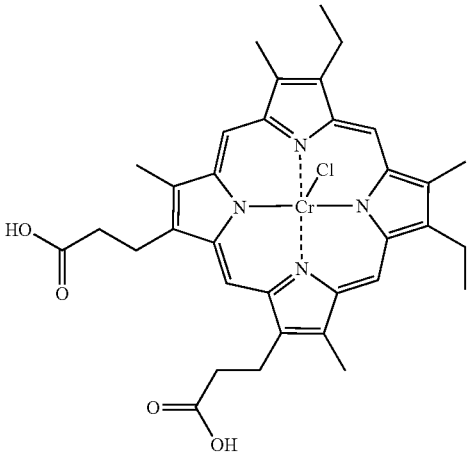
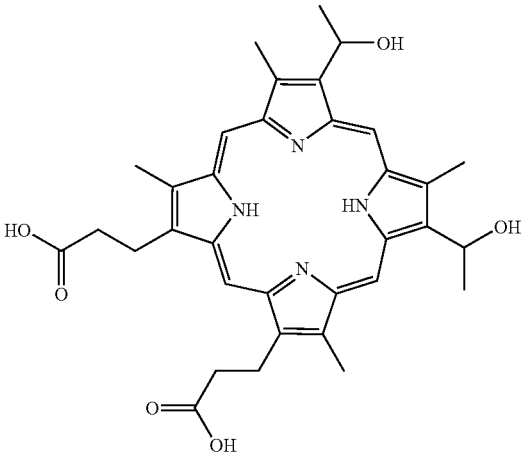
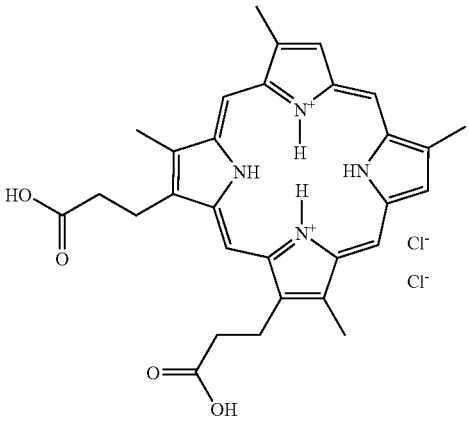
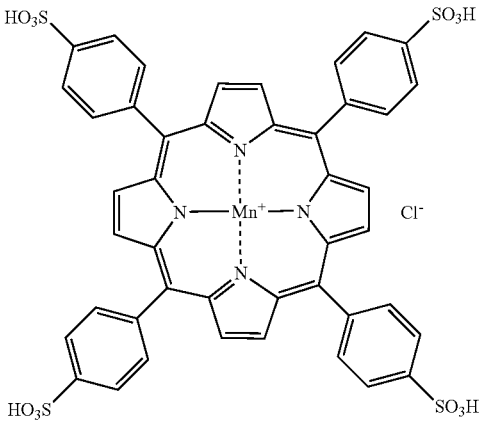

-continued
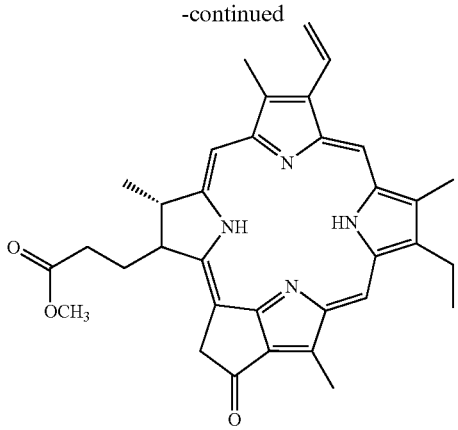
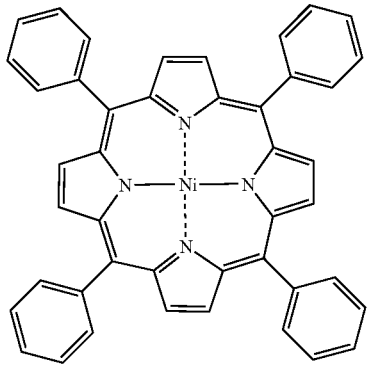
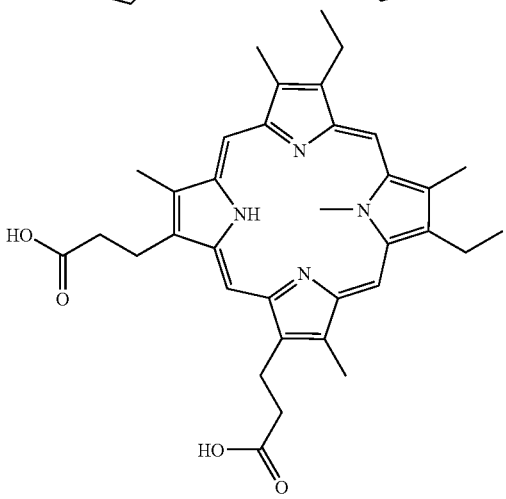
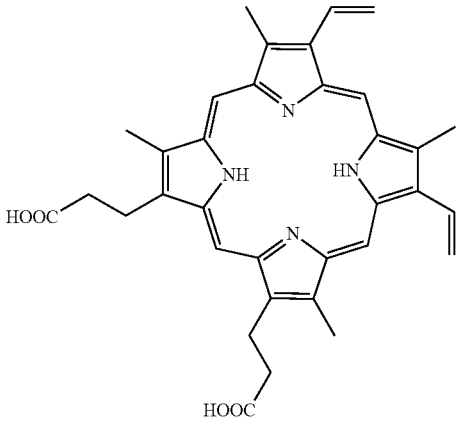
-continued
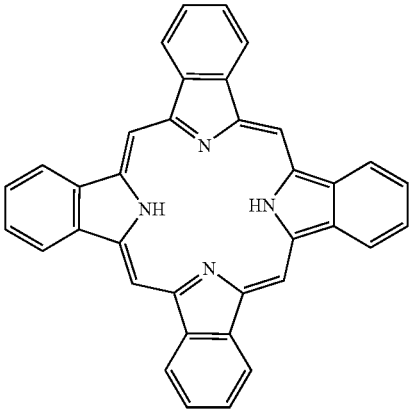
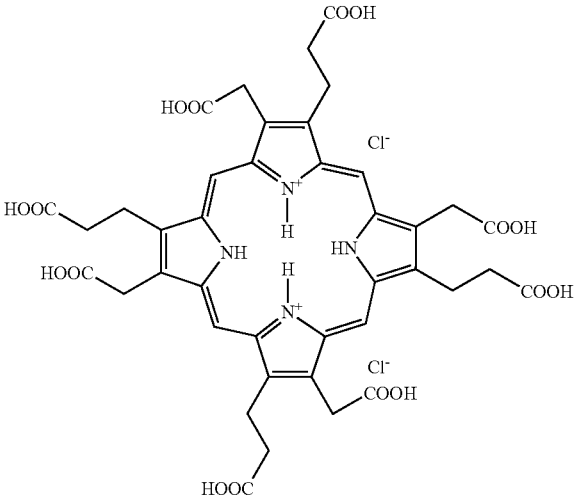
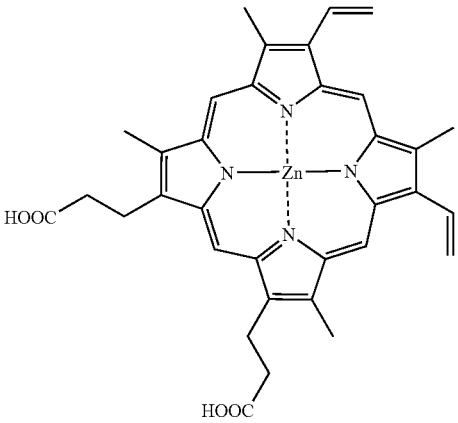

-continued

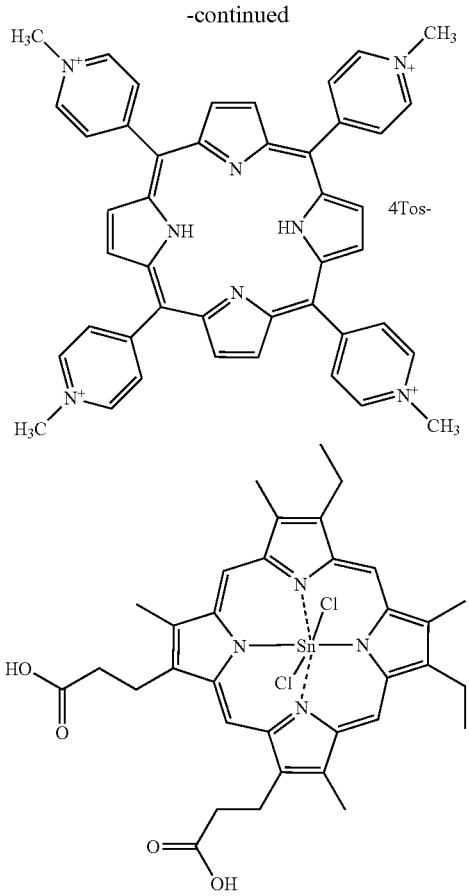

The additives comprise a porphine moiety in its structure, and the porphine additive can be either metal free or metal-containing, with metals such as Cu, Pd, V, Zn, Fe, Sn, Mn and the like. Porphine derivatives with acid substitutes, such as carboxylic acid, sulfonic acid, and the like, may be readily used because they are bind easily onto the surface of a metal oxide like $TiO_2$. Both soluble and dispersible porphine derivatives may be used with embodiments of the invention.

In embodiments, the metal oxide can be selected from, for example, the group consisting of $CeO_2$, ZnO, $SnO_2$, $TiO_2$, $Al_2O_3$, $SiO_2$, $ZrO_2$, $In_2O_3$, $MoO_3$, and a mixture thereof. In various embodiments, the metal oxide can be $TiO_2$. In various embodiments, $TiO_2$ can be either surface treated or untreated. Surface treatments include, but are not limited to aluminum laurate, alumina, zirconia, silica, silane, methicone, dimethicone, sodium metaphosphate, and the like and mixtures thereof. Examples of $TiO_2$ include MT-150W (surface treatment with sodium metaphosphate, Tayca Corporation), STR-60N (no surface treatment, Sakai Chemical Industry Co., Ltd.), FTL-100 (no surface treatment, Ishihara Sangyo Laisha, Ltd.), STR-60 (surface treatment with A1203, Sakai Chemical Industry Co., Ltd.), TTO-55N (no surface treatment, Ishihara Sangyo Laisha, Ltd.), TTO-55A (surface treatment with Al2O3, Ishihara Sangyo Laisha, Ltd.), MT-150AW (no surface treatment, Tayca Corporation), MT-150A (no surface treatment, Tayca Corporation), MT-100S (surface treatment with aluminum laurate and alumina, Tayca Corporation), MT-100HD (surface treatment with zirconia and alumina, Tayca Corporation), MT-100SA (surface treatment with silica and alumina, Tayca Corporation), and the like. The metal oxide can be a doped metal oxide selected from the group consisting of nitrogen doped titanium oxide, carbon doped titanium oxide, zinc doped titanium oxide, antimony doped titanium dioxide, and mixtures thereof. The metal oxide is incorporated into the undercoat layer formulation.

Undercoat layer binder materials are well known in the art. Typical undercoat layer binder materials include, for example, polyesters, MOR-ESTER 49,000 from Morton International Inc., VITEL PE-100, VITEL PE-200, VITEL PE-200D, and VITEL PE-222 from Goodyear Tire and Rubber Co., polyarylates such as ARDEL from AMOCO Production Products, polysulfone from AMOCO Production Products, polyurethanes, and the like. Other examples of suitable undercoat layer binder materials include, but are not limited to, a polyamide such as Luckamide 5003 from DAINIPPON Ink and Chemicals, Nylon 8 with methylmethoxy pendant groups, CM 4000 and CM 8000 from Toray Industries Ltd and other N-methoxymethylated polyamides, such as those prepared according to the method described in Sorenson and Campbell "Preparative Methods of Polymer Chemistry" second edition, p. 76, John Wiley and Sons Inc. (1968), and the like and mixtures thereof. These polyamides can be alcohol soluble, for example, with polar functional groups, such as methoxy, ethoxy and hydroxy groups, pendant from the polymer backbone. Another examples of undercoat layer binder materials include phenolic-formaldehyde resin such as VARCUM 29159 from OXYCHEM, aminoplast-formaldehyde resin such as CYMEL resins from CYTEC, poly (vinyl butyral) such as BM-1 from Sekisui Chemical, and the like and mixtures thereof.

The weight/weight ratio of the porphine additive and the metal oxide is from about 0.0001/1 to about 0.5/1, or from about 0.001/1 to about 0.1/1, or from about 0.01/1 to about 0.05/1. The weight/weight ratio of the porphine additive in the undercoat layer formulation is from about 0.0001/1 to about 0.3/1, or from about 0.001/1 to about 0.05/1, or from about 0.01/1 to about 0.03/1.

The undercoat layer may consist of one, one or more, or a mixture thereof, of the above porphine structures and a polymeric binder. In one embodiment, the binder is hydrophilic melamine-formaldehyde resin. The weight/weight ratio of the porphine additive and the binder is from about 0.001/1 to about 0.1/1, or from about 0.01/1 to about 0.03/1.

In various embodiments, the undercoat layer further contains an optional light scattering particle. In various embodiments, the light scattering particle has a refractive index different from the binder and has a number average particle size greater than about 0.8 μm. The light scattering particle can be amorphous silica or silicone ball. In various embodiments, the light scattering particle can be present in an amount of from about 0% to about 10% by weight of the total weight of the undercoat layer.

In various embodiments, the undercoat layer has a thickness of from about 0.1 μm to about 30 μm, or from about 2 μm to about 25 μm, or from about 10 μm to about 20 μm. The metal oxide may be present in an amount of from about 20 percent to about 80 percent by weight of the total weight of the undercoat layer.

In embodiments, the porphine additive is physically mixed or dispersed into the undercoat formulation comprising $TiO_2$, phenolic resin, and melamine resin. Some methods that can be used to incorporate an additive into a formulation to form an undercoat layer include the following: (1) simple mixing of a porphine additive, with an undercoat layer formulation, with the formulation being previously dispersed before adding the porphine or its derivative (2) ball milling a porphine additive with the undercoat layer formulation. In particular embodiments, where the metal oxide is $TiO_2$, the $TiO_2$ may have a powder volume resistivity of from about $1\times10^4$ to about $1\times10^{10}$ Ωcm under a 100 kg/cm$^2$ loading pressure at 50 percent humidity and at 25° C.

After forming the coating for the undercoat layer, the coating is applied to the imaging member substrate. The coating having the metal oxide and the porphine additive is applied onto the substrate to form an undercoat layer.

The undercoat layer may be applied or coated onto a substrate by any suitable technique known in the art, such as spraying, dip coating, draw bar coating, gravure coating, silk screening, air knife coating, reverse roll coating, vacuum deposition, chemical treatment and the like. Additional vacuuming, heating, drying and the like, may be used to remove any solvent remaining after the application or coating to form the undercoat layer.

While the description above refers to particular embodiments, it will be understood that many modifications may be made without departing from the spirit thereof. The accompanying claims are intended to cover such modifications as would fall within the true scope and spirit of embodiments herein.

The presently disclosed embodiments are, therefore, to be considered in all respects as illustrative and not restrictive, the scope of embodiments being indicated by the appended claims rather than the foregoing description. All changes that come within the meaning of and range of equivalency of the claims are intended to be embraced therein.

EXAMPLES

The examples set forth herein below and are illustrative of different compositions and conditions that can be used in practicing the invention. All proportions are by weight unless otherwise indicated. It will be apparent, however, that the invention can be practiced with many types of compositions and can have many different uses in accordance with the disclosure above and as pointed out hereinafter.

Comparative Example I

A controlled undercoat layer dispersion was prepared as follows: a titanium oxide/phenolic resin/melamine resin dispersion was prepared by ball milling 15 grams of titanium dioxide (MT-150W, Tayca Company), 8 grams of the phenolic resin (VARCUM 29159, OxyChem Company, $M_w$ of about 3,600, viscosity of about 200 cps) and 7.5 grams of the melamine resin (CYMEL 323, CYTEC) in 7.5 grams of 1-butanol, and 7.5 grams of xylene with 120 grams of 1 millimeter diameter sized $ZrO_2$ beads for 5 days. The resulting titanium dioxide dispersion was filtered with a 20 micrometer pore size nylon cloth, and then the filtrate was measured with HORIBA CAPA 700 Particle Size Analyzer, and there was obtained a median $TiO_2$ particle size of 50 nanometers in diameter and a $TiO_2$ particle surface area of 30 m$^2$/gram with reference to the above $TiO_2$/VARCUM/CYMEL dispersion. 0.5 grams of methyl ethyl ketone were added into the dispersion to obtain the coating dispersion. An aluminum drum, cleaned with detergent and rinsed with deionized water, was then coated with the above generated coating dispersion, and subsequently dried at 160° C. for 40 minutes, which resulted in the TUC8 layer deposited on the aluminum and comprised of $TiO_2$/VARCUM/CYMEL with a weight ratio of about 60/16/24 and a thickness of 5.5 microns.

Example I

An invented undercoat layer dispersion was prepared as follows: a porphine/titanium oxide/phenolic resin/melamine resin dispersion was prepared by ball milling 0.25 grams of meso-Tetraphenylporphine-4,4',4",4'"-tetracarboxylic acid (commercially available from Frontier Scientific, Inc., Logan, Utah), 15 grams of titanium dioxide (MT-150W, Tayca Company), 8 grams of the phenolic resin (VARCUM 29159, OxyChem Company, $M_w$ of about 3,600, viscosity of about 200 cps) and 7.5 grams of the melamine resin (CYMEL 323, CYTEC) in 7.5 grams of 1-butanol, and 7.5 grams of xylene with 120 grams of 1 millimeter diameter sized $ZrO_2$ beads for 5 days. The resulting titanium dioxide dispersion was filtered with a 20 micrometer pore size nylon cloth, and then the filtrate was measured with HORIBA CAPA 700 Particle Size Analyzer, and there was obtained a median $TiO_2$ particle size of 50 nanometers in diameter and a $TiO_2$ particle surface area of 30 m$^2$/gram with reference to the above Porphine/$TiO_2$/VARCUM/CYMEL dispersion. 0.5 grams of methyl ethyl ketone were added into the dispersion to obtain the coating dispersion. An aluminum drum, cleaned with detergent and rinsed with deionized water, was then coated with the above generated coating dispersion, and subsequently dried at 160° C. for 40 minutes, which resulted in the TUC8 layer deposited on the aluminum and comprised of $TiO_2$/VARCUM/CYMEL with a weight ratio of about 60/16/24 and a thickness of 5.5 microns.

Example II

An invented undercoat layer dispersion was prepared as follows: a porphine/titanium oxide/phenolic resin/melamine resin dispersion was prepared by ball milling 0.5 grams of 8,13-Bis(vinyl)-3,7,12,17-tetramethyl-21H,23H-porphine-2,18-dipropionic acid zinc(II) (commercially available from Frontier Scientific, Inc., Logan, Utah), 15 grams of titanium dioxide (MT-150W, Tayca Company), 8 grams of the phenolic resin (VARCUM 29159, OxyChem Company, $M_w$ of about 3,600, viscosity of about 200 cps) and 7.5 grams of the melamine resin (CYMEL 323, CYTEC) in 7.5 grams of 1-butanol, and 7.5 grams of xylene with 120 grams of 1 millimeter diameter sized $ZrO_2$ beads for 5 days. The resulting titanium dioxide dispersion was filtered with a 20 micrometer pore size nylon cloth, and then the filtrate was measured with HORIBA CAPA 700 Particle Size Analyzer, and there was obtained a median $TiO_2$ particle size of 50 nanometers in diameter and a $TiO_2$ particle surface area of 30 m$^2$/gram with reference to the above Porphine/$TiO_2$/VARCUM/CYMEL dispersion. 0.5 grams of methyl ethyl ketone were added into the dispersion to obtain the coating dispersion. An aluminum drum, cleaned with detergent and rinsed with deionized water, was then coated with the above generated coating dispersion, and subsequently dried at 160° C. for 40 minutes, which resulted in the TUC8 layer deposited on the aluminum and comprised of $TiO_2$/VARCUM/CYMEL with a weight ratio of about 60/16/24 and a thickness of 5.5 microns.

A chlorogallium phthalocyanine (ClGaPc) photogeneration layer dispersion was prepared as follows: 2.7 grams of ClGaPc Type B pigment was mixed with about 2.3 grams of polymeric binder VMCH (Dow Chemical) and 45 grams of n-butyl acetate. The mixture was milled in an ATTRITOR mill with about 200 grams of 1 mm Hi-Bea borosilicate glass beads for about 3 hours. The dispersion was filtered through a 20-μm nylon cloth filter, and the solid content of the dispersion was diluted to about 5 weight percent with n-butyl acetate. The ClGaPc photogeneration layer dispersion was applied on top of the above undercoat layers, respectively.

The thickness of the photogeneration layer was approximately 0.2 μm. Subsequently, a 16 μm charge transport layer was coated on top of the photogeneration layer from a dispersion prepared from N,N'-diphenyl-N,N-bis(3-methylphenyl)-1,1'-biphenyl-4,4'-diamine (5.38 grams), a film forming polymer binder PCZ 400 [poly(4,4'-dihydroxy-diphenyl-1-1-cyclohexane, Mw=40,000)] available from Mitsubishi Gas Chemical Company, Ltd. (7.13 grams), and PTFE POLYFLON L-2 microparticle (1 gram) available from Daikin Industries dissolved/dispersed in a solvent mixture of 20 grams of tetrahydrofuran (THF) and 6.7 grams of toluene via CAVIPRO 300 nanomizer (Five Star technology, Cleveland, Ohio). The charge transport layer was dried at about 120° C. for about 40 minutes.

The above prepared photoreceptor devices were tested in a scanner set to obtain photo induced discharge curves, sequenced at one charge-erase cycle followed by one charge-expose-erase cycle, wherein the light intensity was incrementally increased with cycling to produce a series of photo induced discharge characteristic curves (PIDC) from which the photosensitivity and surface potentials at various exposure intensities were measured. Additional electrical characteristics were obtained by a series of charge-erase cycles with incrementing surface potential to generate several voltages versus charge density curves. The scanner was equipped with a scorotron set to a constant voltage charging at various surface potentials. The devices were tested at surface potentials of about 500 and about 700 volts with the exposure light intensity incrementally increased by means of regulating a series of neutral density filters. The exposure light source was a 780-nanometer light emitting diode. The aluminum drum was rotated at a speed of about 61 revolutions per minute to produce a surface speed of about 122 millimeters per second. The xerographic simulation was completed in an environmentally controlled light tight chamber at ambient conditions (about 50 percent relative humidity and about 22° C.).

Very similar photo-induced discharge curves (PIDC) were observed for all the photoreceptor devices, thus the incorporation of the porphine additive does not adversely affect PIDC.

The above photoreceptor devices were then acclimated for 24 hours before testing in A-zone (85° F./80% Room Humidity). Print tests were performed in Imari Work centre using black and white copy mode to achieve machine speed of 52 mm/s. CDS levels were measured against an empirical scale, where the smaller the CDS grade level, the better the print quality. In general, a CDS grade reduction of 1 to 2 levels was observed when the porphine additive was incorporated in undercoat layer. Therefore, incorporation of the porphine additive in undercoat layer significantly improves print quality such as CDS.

What is claimed is:

1. An electrophotographic imaging member, comprising:

a substrate;

an undercoat layer formed on the substrate, the undercoat layer having a thickness of from about 0.1 μm to about 30 μm, and wherein the undercoat layer comprises a metal oxide and a porphine additive, the metal oxide comprising $TiO_2$ and the porphine additive comprising meso-Tetraphenylporphine-4,4',4",4'"-tetracarboxylic acid; and a charge transport layer comprising charge transport materials dispersed therein.

2. The electrophotographic imaging member of claim 1, wherein the porphine additive further comprises a porphine material selected from the group consisting of 21H,23H-Porphine, 5,10,15,20-Tetra(4-pyridyl)-21H,23H-porphine, 5,10,15,20-Tetraphenyl-21H,23H-porphine, 5,10,15,20-Tetrakis(o-dichlorophenyl)-21H,23H-porphine, 5,10,15,20-Tetrakis(4-trimethylammoniophenyl)porphine tetrachloride, meso-Tetraphenylporphine-4,4',4",4'"-tetracarboxylic acid copper (II), 5,10,15,20-Tetrakis(4-sulfonatophenyl)-21H,23H-porphine copper(II), 5,10,15,20-Tetrakis(pentafluorophenyl)-21H,23H-porphine palladium(II), 2,3,7,8,12,13,17,18-Octaethyl-21H,23H-porphine vanadium (IV) oxide, Phytochlorin, 5,10,15,20-Tetrakis(3-hydroxyphenyl)-21H,23H-porphine, 3,8,13,18-Tetramethyl-21H,23H-porphine-2,7,12,17-tetrapropionic acid dihydrochloride, 8,13-Divinyl-3,7,12,17-tetramethyl-21H,23H-porphine-2,18-dipropionic acid cobalt(III) chloride, 8,13,-Bis(ethyl)-3,7,12,17-tetramethyl-21H,23H-porphine-2,18-dipropionic acid chromium (III) chloride, 3,7,12,17-Tetramethyl-21H,23H-porphine-2,18-dipropionic acid dihydrochloride, meso-Tetraphenylporphine-4,4',4",4'"-tetracarboxylic acid, iron (III) chloride, 8,13-Bis(1-hydroxyethyl)-3,7,12,17-tetramethyl-21H,23H-porphine-2,18-dipropionic acid, 5,10,15,20-Tetrakis(4-sulfonatophenyl)-21H,23H-porphine, manganese (III) chloride, Pyropheophorbide-α-methyl ester, 5,10,15,20-Tetraphenyl-21H,23H-porphine nickel(II), N-Methyl Mesoporphyrin IX, 8,13-Bis(vinyl)-3,7,12,17-tetramethyl-21H,23H-porphine-2,18-dipropionic acid, 29H,31H-tetrabenzo porphine, Uroporphyrin I dihydrochloride, 8,13-Bis(vinyl)-3,7,12,17-tetramethyl-21H,23H-porphine-2,18-dipropionic acid zinc(II), 5,10,15,20-Tetrakis (1-methyl-4-pyridinio)porphine tetra (p-toluenesulfonate), 8,13-Bis(ethyl)-3,7,12,17-tetramethyl-21H,23H-porphine-2,18-dipropionic acid tin (IV) dichloride, and the like and the mixtures thereof.

3. The electrophotographic imaging member of claim 1, wherein the porphine additive is present in an amount of about 0.01 percent to about 30 percent by weight of total solids in the undercoat layer.

4. The electrophotographic imaging member of claim 1, wherein the $TiO_2$ has a powder volume resistivity of from about $1\times10^4$ to about $1\times10^{10}$ Ωcm under a 100 kg/cm$^2$ loading pressure at 50 percent humidity and at 25° C.

5. The electrophotographic imaging member of claim 1, wherein said metal oxide is a doped metal oxide selected from the group consisting of nitrogen doped titanium oxide, carbon doped titanium oxide, zinc doped titanium oxide, antimony doped titanium dioxide, and mixtures thereof.

6. An image forming apparatus for forming images on a recording medium comprising:

a) an electrophotographic imaging member having a charge retentive-surface to receive an electrostatic latent image thereon, wherein the electrophotographic imaging member comprises a substrate, an undercoat layer formed on the substrate, the undercoat layer having a thickness of from about 0.1 μm to about 30 μm, and wherein the undercoat layer comprises a metal oxide and a porphine additive, the metal oxide comprising $TiO_2$ and the porphine additive comprising meso-Tetraphenylporphine-4,4',4",4'"-tetracarboxylic acid, and a charge transport layer comprising charge transport materials dispersed therein;

b) a development component to apply a developer material to the charge-retentive surface to develop the electrostatic latent image to form a developed image on the charge-retentive surface;

c) a transfer component for transferring the developed image from the charge-retentive surface to another member or a copy substrate; and d) a fusing member to fuse the developed image to the copy substrate.

7. The image forming apparatus of claim 6, wherein the porphine additive further comprises porphine or porphine derivatives selected from the group consisting of 21 H,23H-Porphine, 5,10,15,20-Tetra(4-pyridyl)-21H,23H-porphine, 5,10,15,20-Tetraphenyl-21H,23H-porphine, 5,10,15,20-Tetrakis(o-dichlorophenyl)-21H,23H-porphine, 5,10,15,20-Tetrakis(4-trimethylammoniophenyl)porphine tetrachloride, meso-Tetraphenylporphine-4,4',4",4'"-tetracarboxylic acid copper (II), 5,10,15,20-Tetrakis(4-sulfonatophenyl)-21H,23H-porphine copper(II), 5,10,15,20-Tetrakis(pentafluorophenyl)-21H,23H-porphine palladium(II), 2,3,7,8,12,13,17,18-Octaethyl-21H,23H-porphine vanadium (IV) oxide, Phytochlorin, 5,10,15,20-Tetrakis(3-hydroxyphenyl)-21H,23H-porphine, 3,8,13,18-Tetramethyl-21H,23H-porphine-2,7,12,17-tetrapropionic acid dihydrochloride, 8,13-Divinyl-3,7,12,17-tetramethyl-21H,23H-porphine-2,18-dipropionic acid cobalt(III) chloride, 8,13,-Bis(ethyl)-3,7,12,17-tetramethyl-21H,23H-porphine-2,18-dipropionic acid chromium (III) chloride, 3,7,12,17-Tetramethyl-21H,23H-porphine-2,18-dipropionic acid dihydrochloride, meso-Tetraphenylporphine-4,4',4",4'"-tetracarboxylic acid, iron (III) chloride, 8,13-Bis(1-hydroxyethyl)-3,7,12,17-tetramethyl-21H,23H-porphine-2,18-dipropionic acid, 5,10,15,20-Tetrakis(4-sulfonatophenyl)-21H,23H-porphine, manganese (III) chloride, Pyropheophorbide-α-methyl ester, 5,10,15,20-Tetraphenyl-21H,23H-porphine nickel(II), N-Methyl Mesoporphyrin IX, 8,13-Bis(vinyl)-3,7,12,17-tetramethyl-21H,23H-porphine-2,18-dipropionic acid, 29H,31H-tetrabenzo porphine, Uroporphyrin I dihydrochloride, 8,13-Bis(vinyl)-3,7,12,17-tetramethyl-21H,23H-porphine-2,18-dipropionic acid zinc(II), 5,10,15,20-Tetrakis (1-methyl-4-pyridinio)porphine tetra (p-toluenesulfonate), 8,13-Bis(ethyl)-3,7,12,17-tetramethyl-21H,23H-porphine-2,18-dipropionic acid tin (IV) dichloride, and the like and the mixtures thereof.

8. The image forming apparatus of claim 6, further comprising a metal oxide selected from the group consisting of ZnO, $SnO_2$, $Al_2O_3$, $SiO_2$, $ZrO_2$, $In_2O_3$, $MoO_3$, $ZrO_2$, $CeO_2$, and mixtures thereof.

9. The image forming apparatus of claim 6, wherein the $TiO_2$ has a powder volume resistivity of from about $1\times10^4$ to about $1\times10^{10}$ Ωcm under a 100 kg/cm$^2$ loading pressure at 50 percent humidity and at 25° C.

* * * * *